US005704565A

United States Patent [19]

Cheng

[11] Patent Number: 5,704,565

[45] Date of Patent: Jan. 6, 1998

[54] TOILET PAPER DISPENSER WITH STORAGE SHELF

[76] Inventor: Terry L. Cheng, 6742 Edgeworth Dr., Orlando, Fla. 32819

[21] Appl. No.: 640,154

[22] Filed: Apr. 30, 1996

[51] Int. Cl.[6] ..... B65H 67/04

[52] U.S. Cl. ..... 242/560.2; 242/597.7; 242/597.8

[58] Field of Search ..... 242/560.2, 560, 242/594.3, 597.7, 597.8

[56] References Cited

U.S. PATENT DOCUMENTS

| | | | |
|---|---|---|---|
| 1,836,969 | 12/1931 | Hick | 242/594.3 X |
| 2,872,124 | 2/1959 | Sieven | 242/595 X |
| 3,370,805 | 2/1968 | Barbee | 242/597.7 X |
| 3,844,500 | 10/1974 | Krause | 242/597.8 X |
| 3,941,325 | 3/1976 | Krause | 242/597.8 X |

FOREIGN PATENT DOCUMENTS

| | | | |
|---|---|---|---|
| 877133 | 8/1971 | Canada | 242/560.2 |

*Primary Examiner*—Daniel P. Stodola
*Assistant Examiner*—Gregory J. Strimbu
*Attorney, Agent, or Firm*—John V. Stewart

[57] ABSTRACT

At improved toilet paper dispenser with a vertical spindle for holding and dispensing rolled toilet paper, having a storage shelf for a spare roll. The improved dispenser mounts on the horizontal spindle of a conventional dispenser and is stabilized against the base of the conventional dispenser.

5 Claims, 8 Drawing Sheets

TOILET PAPER DISPENSER WITH STORAGE SHELF

BACKGROUND

1. Field

This invention relates to dispensers for toilet paper in conventional rolls.

2. Prior Art

Standard toilet paper dispensers comprise a horizontal spindle mounted between arms attached to a vertical surface such as the wall of a bathroom or toilet stall. The spindle commonly telescopes into opposed depressions in the mounting arms, and is urged to extend into the depressions by an internal compression spring. A roll of toilet paper is mounted on the spindle. For roll replacement, the spindle is compressed by the user and released from the arms.

Standard dispensers have too little friction for consistently tearing the paper with one hand, so the roll may unwind unless two hands are used—one hand holds the roll while the other hand tears the paper. Some dispensers provide a spring which brakes the roll. However, these brakes often cause the paper to separate at every sheet, so the user must turn the roll before tearing.

Standard dispensers only hold one paper roll at a time. Multiple roll dispensers are available for public rest-rooms, but are not common in home rest-rooms. Dispensers for public rest-rooms are not ideal for homes, due to their institutional appearance, expense, size, inconvenience, or use of non-standard paper rolls. Some have a lock and/or other means to prevent paper roll theft, which is an unnecessary expense for home use. Some cause the paper to separate at every sheet, which is inconvenient.

If a home user wishes to upgrade to a better dispenser, the original dispenser must be removed. Removal and replacement of an original dispenser often requires ceramic tile expertise, since many original dispensers are ceramic, and are grouted into a tiled wall.

OBJECTIVES and SUMMARY

Objectives: The objective of this invention is an inexpensive toilet paper dispenser with improved convenience, that saves time, has two-roll capacity, and mounts on the horizontal spindle of existing dispensers without tools.

Summary: The invention is an improved toilet paper dispenser with a vertical spindle for standard rolls of toilet paper, and a storage shelf for a spare roll. The improved dispenser mounts on the horizontal spindle of a conventional dispenser.

DRAWINGS

Figure 1:
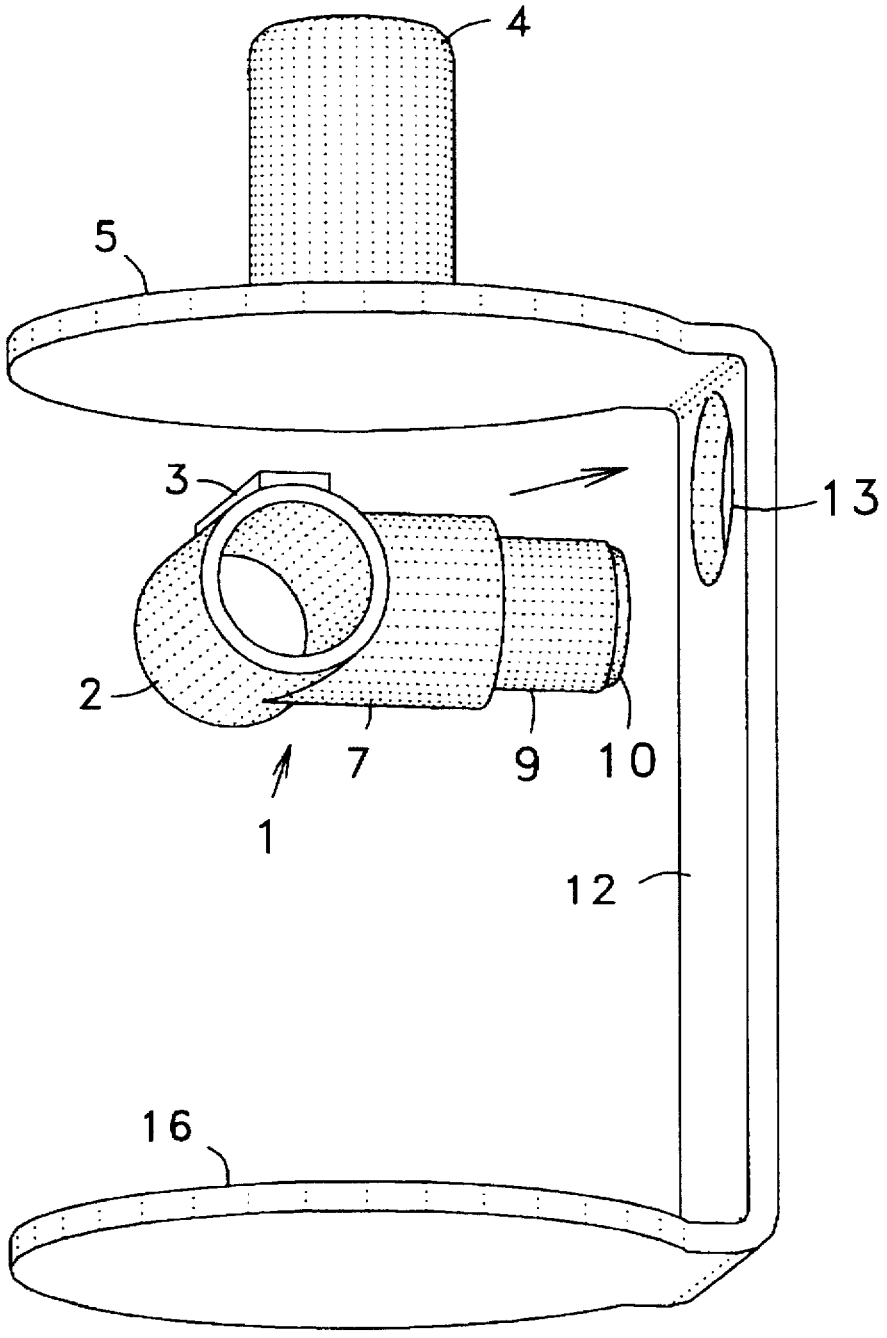

FIG. 1 External view of dispenser before attachment of adaptor sub-assembly

Figure 2:
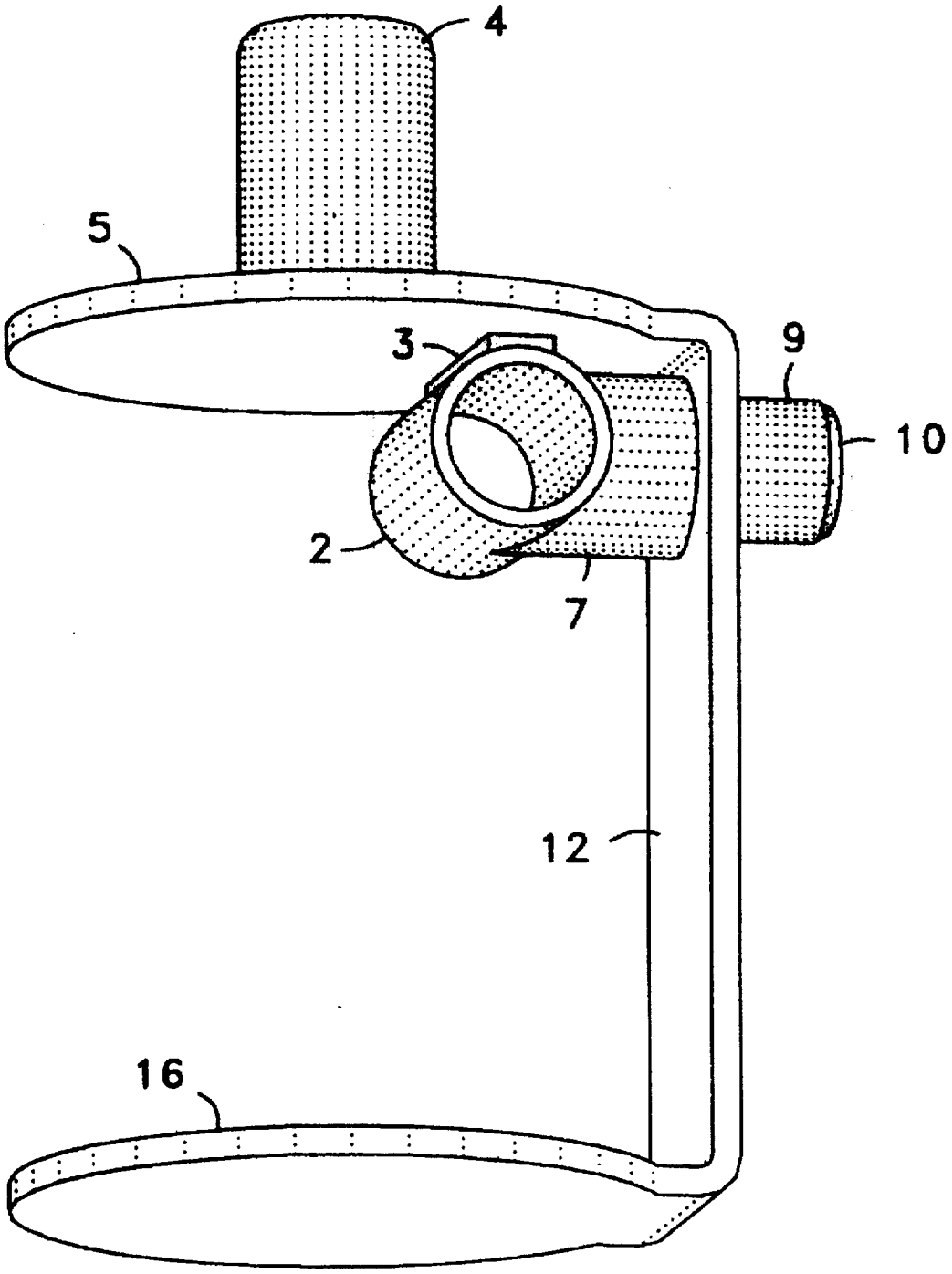

FIG. 2 External view of dispenser after final assembly

Figure 3:
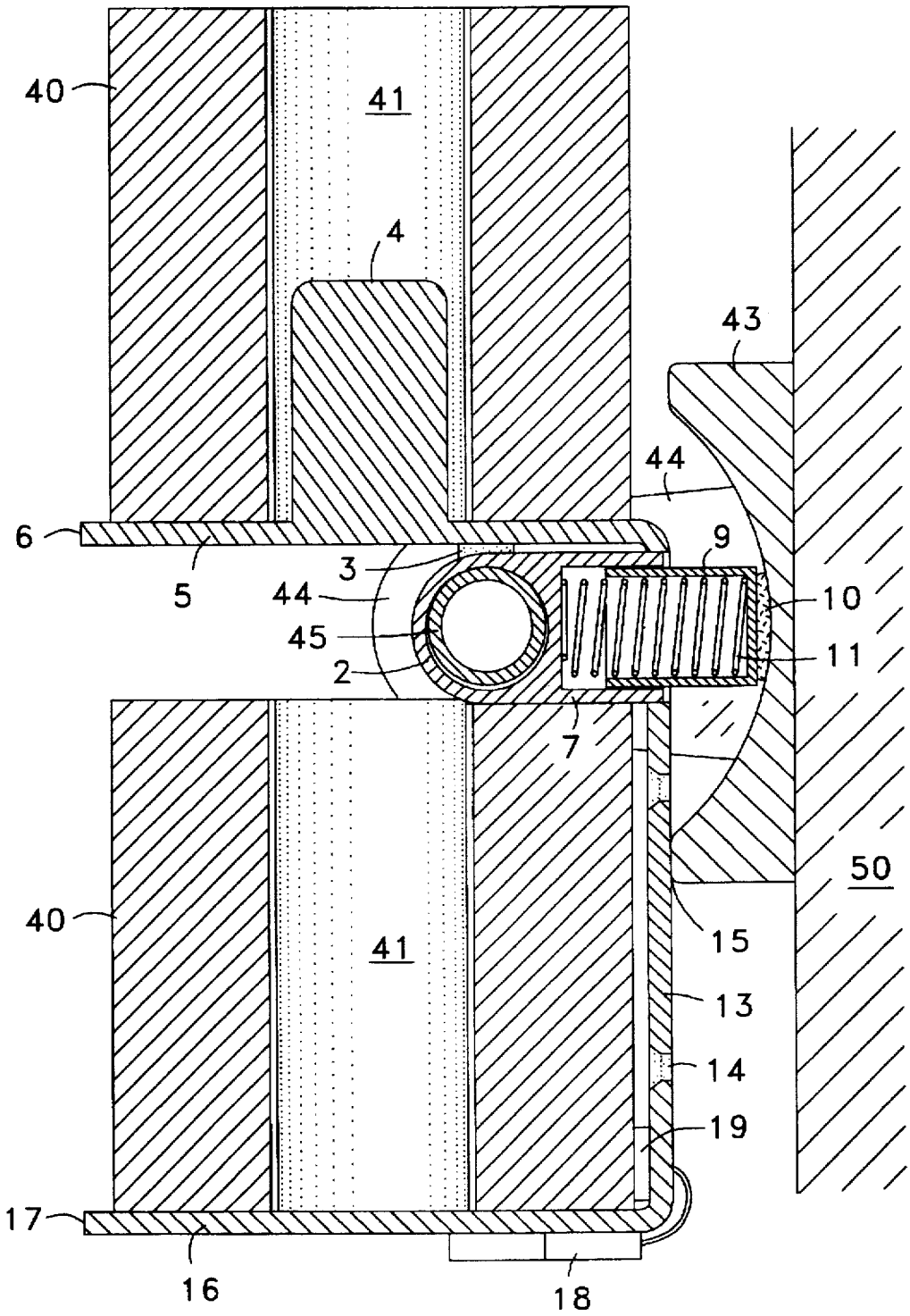

FIG. 3 Sectional view of dispenser mounted on a conventional horizontal spindle (45) via the adaptor tube (2)

Figure 4:
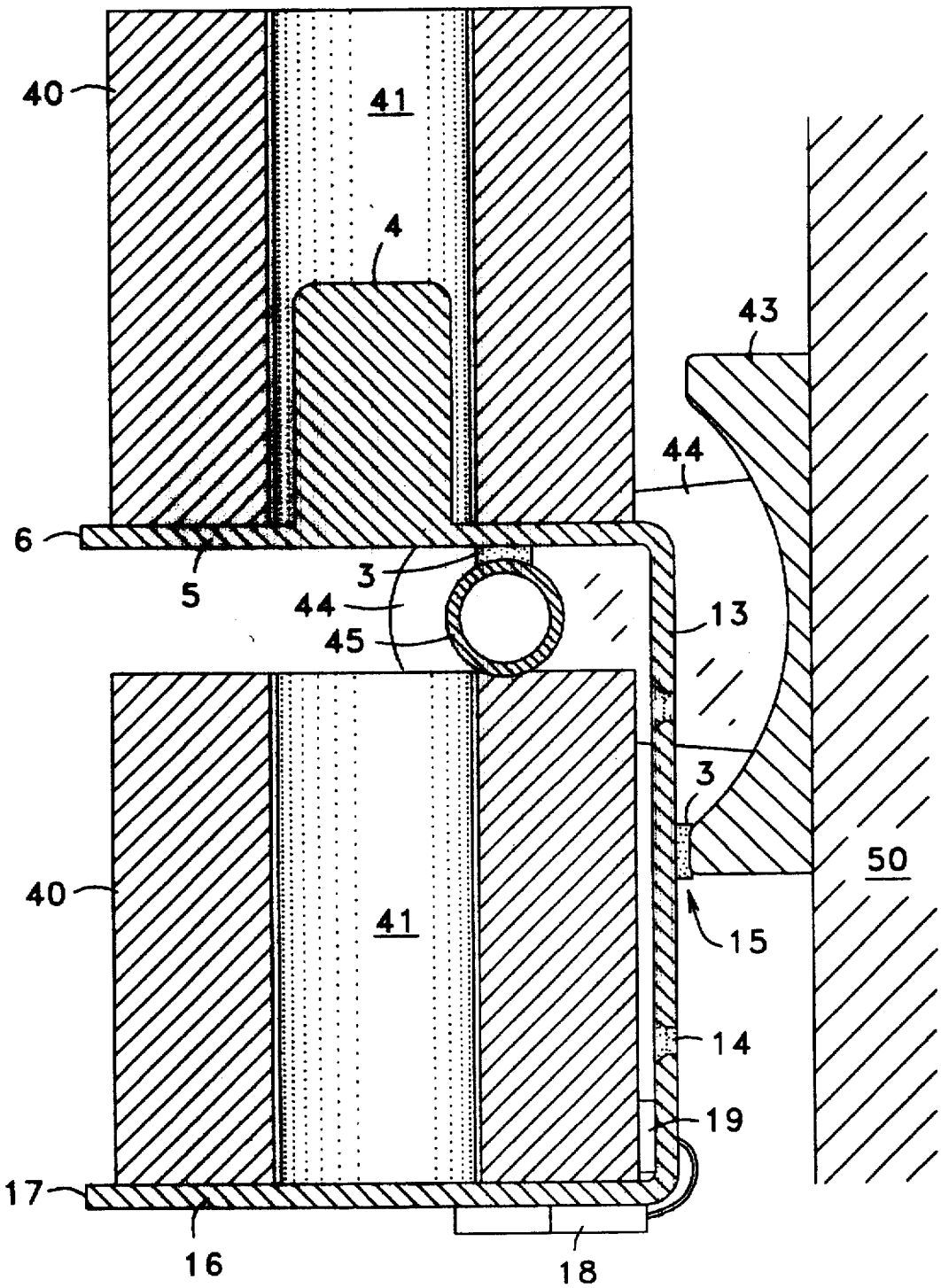

FIG. 4 Sectional view of a simplified embodiment of dispenser

Figure 5:
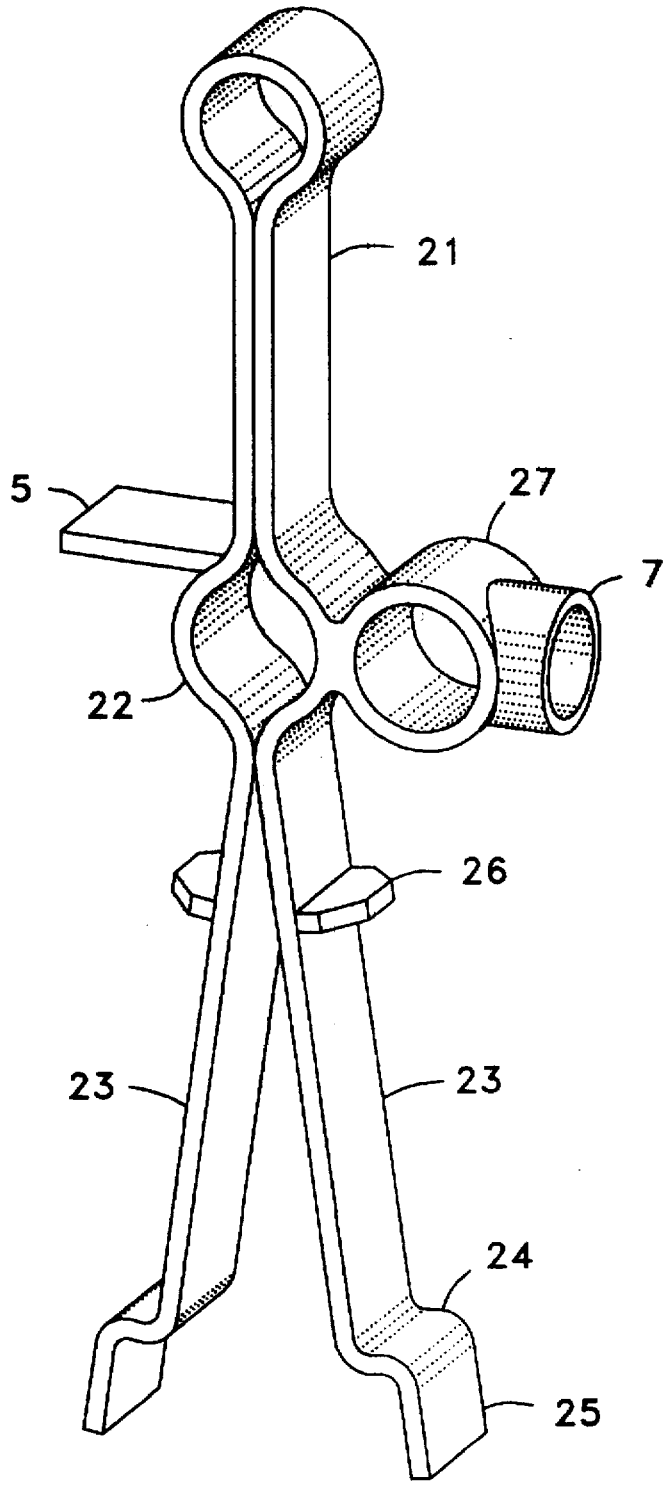

FIG. 5 External view of a third embodiment of dispenser

Figure 6:
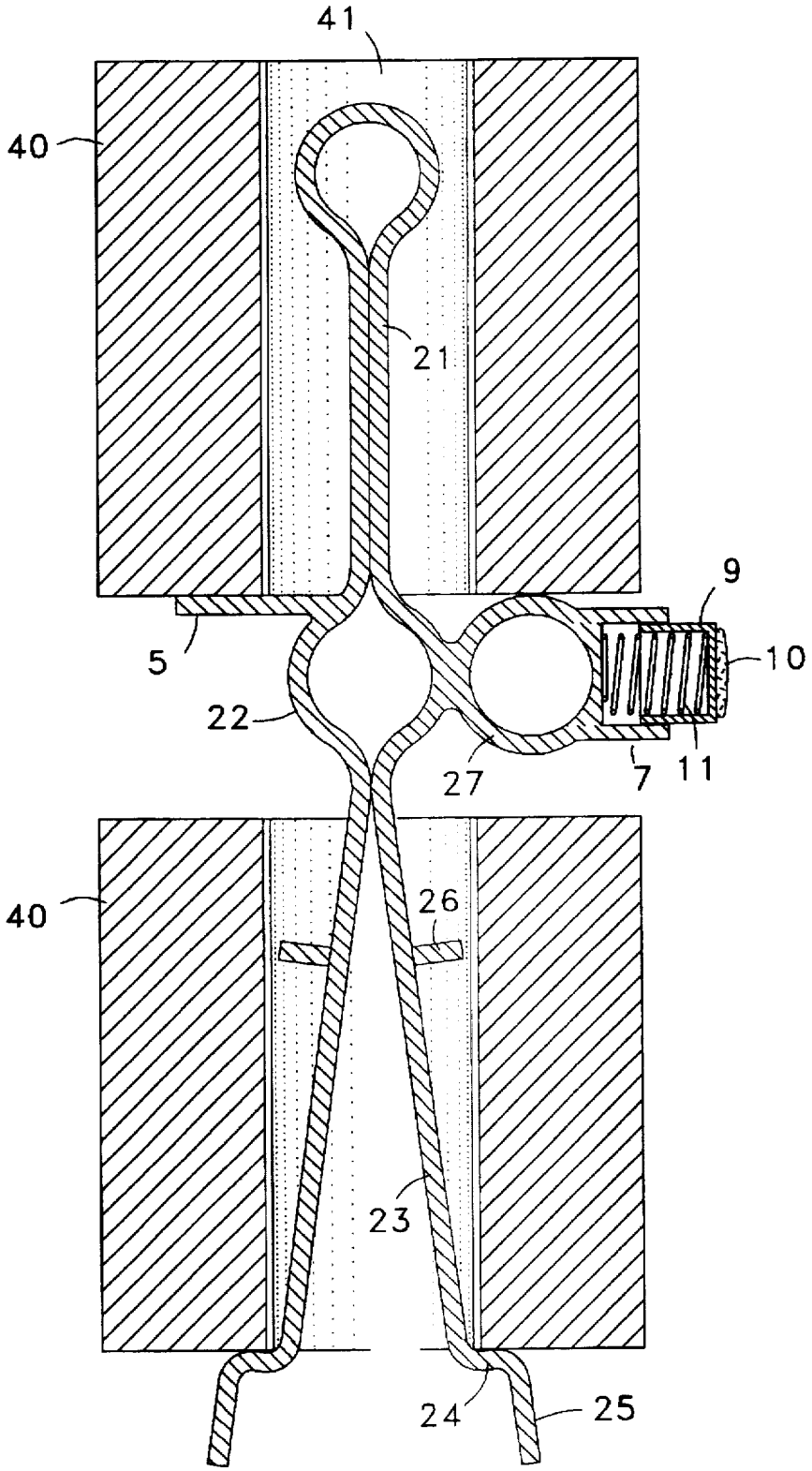

FIG. 6 Sectional view of the embodiment of FIG. 5

Figure 7:
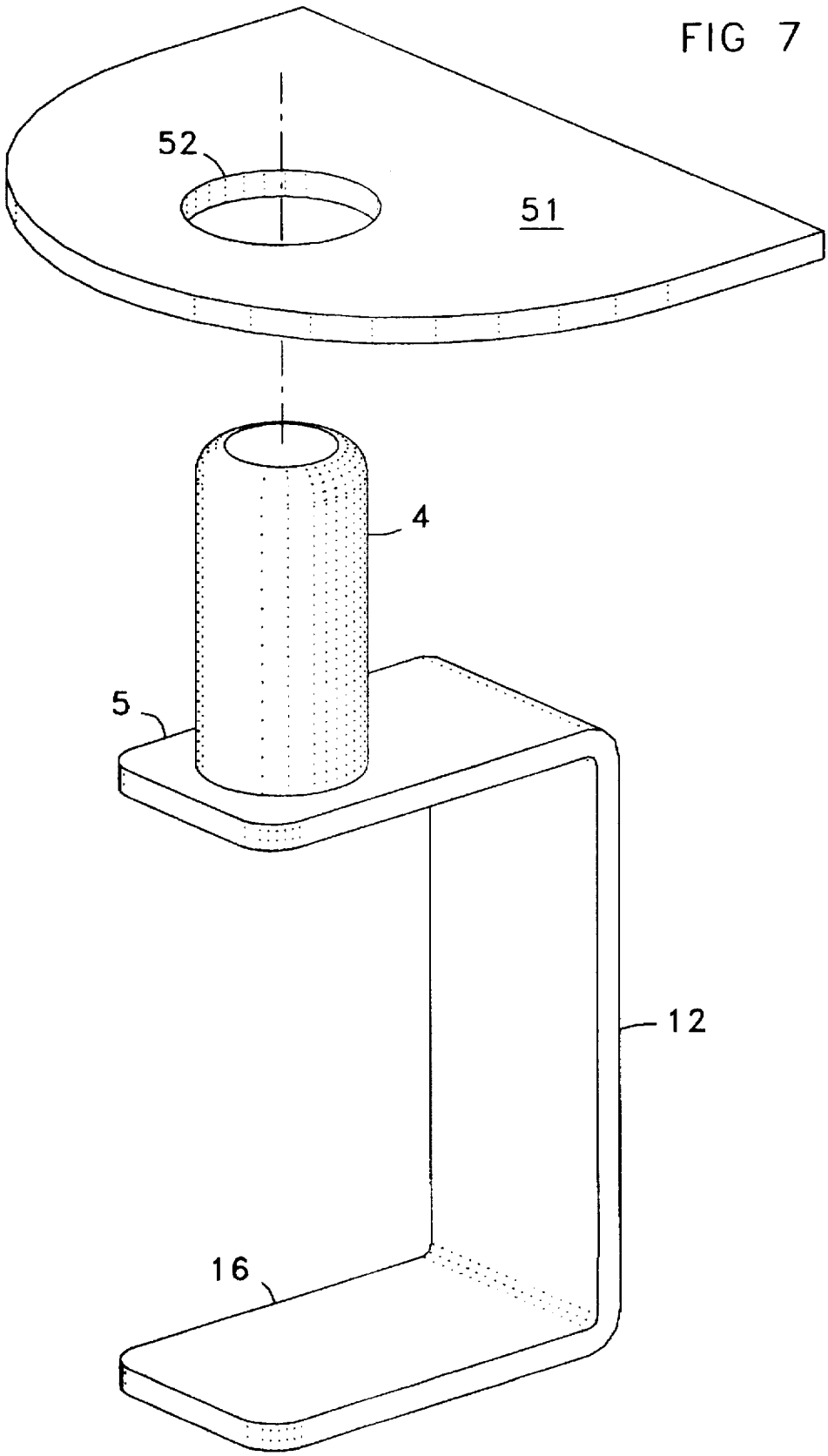

FIG. 7 Exploded external view of basic dispenser with decorative shelf

Figure 8:
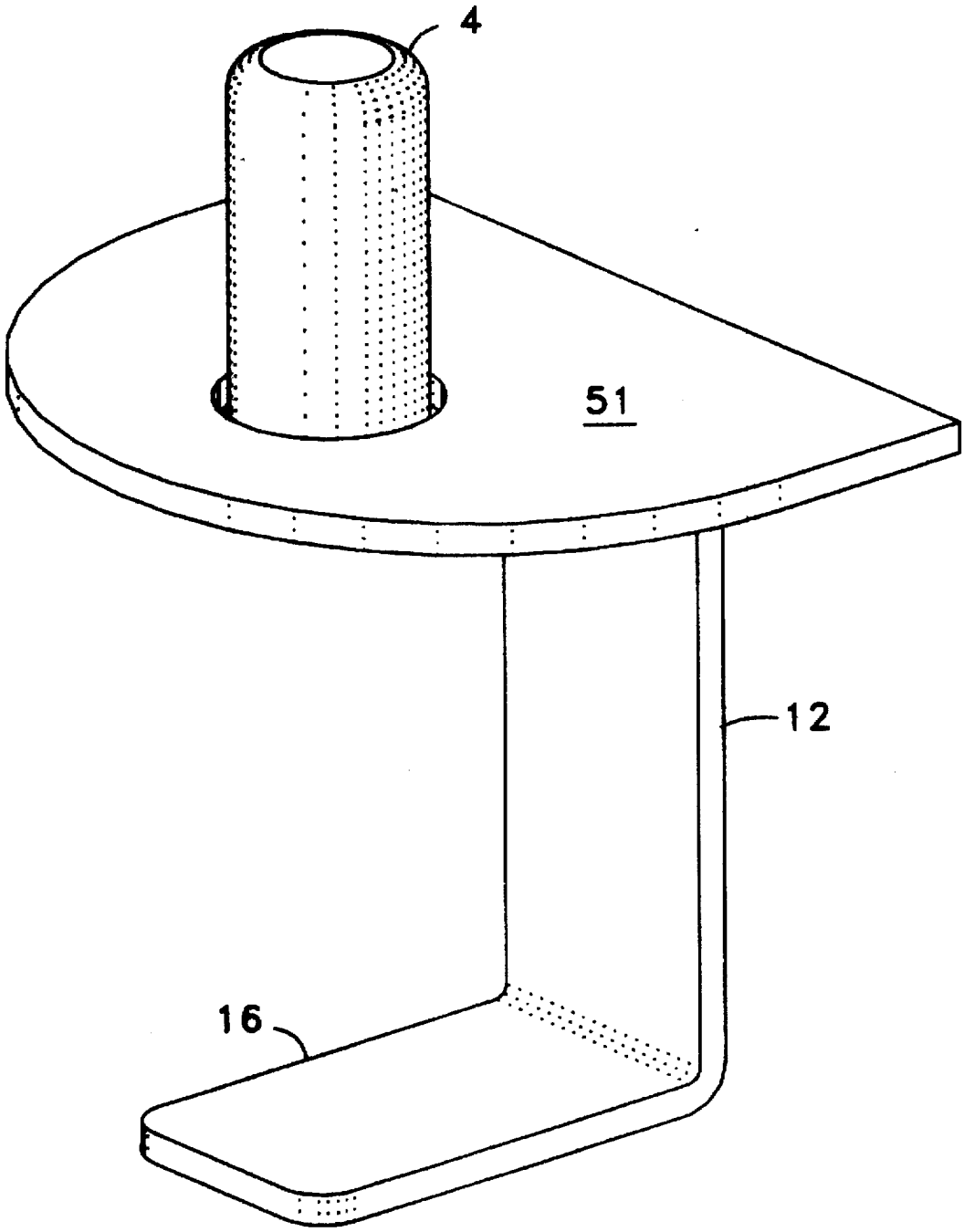

FIG. 8 External view of basic dispenser with decorative shelf in place

REFERENCE NUMERALS

1. Adaptor sub-assembly
2. Adaptor tube
3. Two-sided adhesive tape
4. Vertical spindle
5. Horizontal dispenser shelf
6. Location for optional label on dispenser shelf
7. Guide tube for telescoping brace
9. Brace or stabilizer
10. Non-skid pad
11. Spring
12. Vertical spine
13. Brace guide hole in spine
14. Optional screw hole for direct wall mounting
15. Contact point of spine with conventional dispenser base
16. Horizontal storage shelf
17. Location for optional label on storage shelf
18. Sound generator
19. Sensor
21. Vertical spindle portion of formed strip
22. Adaptor tube portion of formed strip
23. Vertical elastic arms
24. Outwardly projecting tabs
25. Finger grips
26. Roll centering wings
27. Second adaptor tube
40. Toilet paper roll
41. Toilet paper roll center
43. Base of conventional toilet paper dispenser
44. Support arm for horizontal spindle of conventional dispenser
45. Conventional horizontal spindle
50. Dispenser mounting surface
51. Removable decorative shelf
52. Hole for spindle

DESCRIPTION

FIG. 1 shows the improved dispenser ready for attachment of the adaptor sub-assembly (1) to the dispenser shelf (5) with two-sided tape (3). The user performs the above attachment step in order to tailor the position of the adaptor sub-assembly to the dimensions of the existing fixture. The stabilizer guide tube (7) is inserted through a brace guide hole (13) in the spine (12) as shown in FIG. 2.

FIG. 3 is a sectional view of the improved dispenser mounted on the horizontal spindle (45) of a conventional dispenser. The arms (44) and bases (43) of conventional dispensers have a range of shapes and dimensions. The adaptor tube (2) is positioned by the user at the specific distance from the spine (12) such that the spine is vertical when it contacts the base (43) of the existing fixture. The brace (9) presses against the base (43), holding the improved dispenser steady during use.

The stabilizer brace (9) is a tube which is closed at one end, and contains a compression spring. It slides within, and telescopes from, a guide tube (7) attached to the adaptor tube (2). To accommodate the range of dimensions of existing dispensers, a short and a long stabilizer brace may be provided. The user selects the appropriate brace for the existing fixture dimensions, and inserts it in the guide tube. A non-skid pad (10) on the end of the brace is beneficial, or two-sided adhesive tape may be used in place of the non-skid pad for a firm grip.

An optional lower shelf (16) holds a spare roll of paper. To retain the roll, the shelf has a rim, depression, or short spindle (not shown), or the roll is wedged between the lower shelf and the adaptor sub-assembly (1).

A sound generator (18) may optionally be added to the lower shelf, with a switch (19) that detects the presence of a spare roll of paper. When the spare roll is removed, an audible reminder is produced, prompting the user to replace the spare. The reminder may take the form of verbal instructions, music, or a simple tone.

FIG. 4 shows a simplified embodiment of the invention, in which the conventional horizontal spindle (45) is attached directly to the bottom surface of the dispenser shelf (5) with two-sided tape (3) or other means. The spine (12) is attached to the base of the existing dispenser at a contact point (15) with two-sided tape (3) or other means. If the arms of the existing dispenser are individually attached directly to the wall (50), then the wall serves as the base, and the spine is attached to the wall at a contact point. In FIG. 4 the spare roll is retained frictionally between the storage shelf (16) and the existing spindle (45), although the other means previously mentioned can be used. FIGS. 7 and 8 show also show this simplified embodiment, with an optional decorative shelf as later described.

FIGS. 5 and 6 shows a third embodiment of the invention, in which a strip of semi-elastic material, such as plastic, is formed into a vertical spindle portion (21), an adaptor tube portion (22), and two diverging arms (23). The diverging arms are squeezed together and inserted through a spare roll of paper. The spare roll is retained by outwardly projecting tabs (24) on the bottom of the arms. A second adaptor tube (27) is provided to accommodate a range of dimensions of conventional dispensers. A guide tube (7) on the second adaptor tube holds a brace (9) as shown in FIGS. 1–4. The brace is relied upon to hold the dispenser vertical. A non-slip pad on the end of the brace is beneficial, or two-sided adhesive tape may be used for a firm grip. Roll centering wings (26) hold the spare roll upright to prevent a poor appearance caused by tilting of the spare roll.

The dispenser shelf in the embodiments of FIGS. 1–6, and the storage shelf of FIGS. 1–4, may be plain, small, and structural. As shown in FIGS. 7 and 8, these shelves only need to be as wide as the spine, which optimizes production. A removable decorative shelf (51) may be placed on top of the dispenser shelf. It has a central hole (52) to receive the vertical spindle which retains it. The decorative shelf is large enough to extend radially beyond a full roll of toilet paper and may have a variety of shapes and color patterns. It is selected by the user to match a decor or preference, and can be easily changed occasionally for variety.

PREFERRED EMBODIMENT

The preferred embodiment is shown in FIGS. 1–3.

OPERATION OF PREFERRED EMBODIMENT

INSTALLATION

1. Place the adaptor sub-assembly (1) on the bottom of the dispenser shelf (5) with the guide tube (7) in the spine hole (13).

2. Insert the compression spring into the stabilizer brace.

3. Compress the stabilizer brace fully into the guide tube, and maintain compression with one hand.

4. With the other hand, insert the horizontal spindle (45) of a conventional toilet paper dispenser through the adaptor tube.

5. Mount the horizontal spindle in its arms (44), release the stabilizer brace against the base (43), and center the non-skid pad (10) in line with the guide tube.

6. Grasping the vertical spindle, hold the spine vertical as it touches the base (43) of the conventional fixture.

7. Center the dispenser shelf axially on the horizontal spindle, remove the tape backing, and press the adhesive against the bottom of the dispenser shelf. This attaches the adapter tube to the bottom of the horizontal dispenser shelf in the position that holds the spine vertical and centered between the conventional arms (44).

USAGE Mount a roll of toilet paper on the vertical spindle. Pull the end of the paper to unwind it as needed. Set a spare roll of toilet paper on the storage shelf. When the upper roll is depleted, move the spare roll from the storage shelf to the dispenser shelf.

SCOPE

The description and drawings illustrate examples of the invention. Modifications may be made in particulars without departing from the concept and scope of the invention, which is defined by the following claims.

The base of a conventional toilet paper dispenser may be the wall itself, to which each arm of the conventional dispenser is directly attached.

I claim:

1. A toilet paper dispenser comprising:

a vertical spine having a top end and a bottom end;

a horizontal dispenser shelf attached to the top end of the vertical spine, the horizontal dispenser shelf having a top surface and a bottom surface;

a vertical spindle, attached to the top surface of the dispenser shelf, for holding a roll of toilet paper;

a horizontal adapter tube, attached to the bottom surface of the dispenser shelf, for accepting a conventional horizontal spindle;

a generally horizontal guide tube attached perpendicularly to the adapter tube;

a brace tube slidably mounted in the guide tube; and a compression spring, in the brace tube, urging the brace tube to extend from the guide tube.

2. A toilet paper dispenser comprising:

a horizontal adapter tube that accepts a conventional horizontal toilet paper spindle;

a vertical spindle, attached to the adapter tube, for holding a roll of toilet paper;

a horizontal dispenser shelf, attached to the adapter tube, for supporting a roll of toilet paper mounted on the vertical spindle;

a telescoping brace attached generally horizontally and perpendicularly to the adapter tube; and, a compression spring in the telescoping brace, urging the telescoping brace to extend.

3. The toilet paper dispenser of claim 2, further comprising:

a vertical spine extending downward from the adapter tube, the vertical spine having a bottom end; and, a horizontal storage shelf attached to the bottom end of the vertical spine.

4. A toilet paper dispenser comprising:

a vertical spine having a top end and a bottom end;

a horizontal dispenser shelf attached to the top end of the vertical spine, the horizontal dispenser shelf having a top surface and a bottom surface;

a vertical spindle attached to the top surface of the horizontal dispenser shelf;

a horizontal adapter tube, attached to the vertical spine, for accepting a conventional horizontal toilet paper spindle;

a telescoping brace attached generally horizontally and perpendicularly to the adapter tube; and, a compression spring in the telescoping brace, urging the telescoping brace to extend.

5. The toilet paper dispenser of claim 4, further comprising a horizontal storage shelf attached to the bottom end of the vertical spine.

* * * * *